US005241326A

United States Patent [19]

Tagashira

[11] Patent Number: 5,241,326

[45] Date of Patent: Aug. 31, 1993

[54] LINE-TYPE THERMAL PRINTING HEAD

[75] Inventor: Fumiaki Tagashira, Kyoto, Japan

[73] Assignee: Rohm Co., Ltd., Kyoto, Japan

[21] Appl. No.: 923,495

[22] Filed: Aug. 3, 1992

[30] Foreign Application Priority Data

Sep. 13, 1991 [JP] Japan ..... 3-234851

[51] Int. Cl.[5] ..... B41J 2/345; B41J 2/335

[52] U.S. Cl. ..... 346/76 PH

[58] Field of Search ..... 346/76 PH; 219/543

[56] References Cited

U.S. PATENT DOCUMENTS 4,973,986 11/1990 Narita ..... 346/76 PH
5,148,188 9/1992 Ota et al. ..... 346/76 PH

FOREIGN PATENT DOCUMENTS 57-24273 2/1982 Japan .
0064463 4/1986 Japan ..... 346/76 PH
0167575 7/1986 Japan ..... 346/76 PH
61-183652 11/1986 Japan .
64-18649 1/1989 Japan .

*Primary Examiner*—Benjamin R. Fuller
*Assistant Examiner*—Huan Tran
*Attorney, Agent, or Firm*—William H. Eilberg

[57] ABSTRACT

A line-type thermal printing head comprises an elongate support plate, an elongate head substrate mounted on the support plate, and a strip-like auxiliary substrate mounted on the support plate to extend longitudinally of the head substrate. The head substrate is formed with a heating resistor line extending longitudinally of the head substrate, and a common electrode extending substantially in parallel to the resistor line adjacent to a longitudinal edge of the head substrate. The auxiliary substrate has a side surface which is substantially perpendicular to the head substrate and formed with a longitudinal conductor strip connected electrically to the common electrode through a conductive member.

11 Claims, 5 Drawing Sheets

LINE-TYPE THERMAL PRINTING HEAD

BACKGROUND OF THE INVENTION

1. Field of the Invention

This invention relates to a thermal printing head. More specifically, the present invention relates to a line-type thermal printing head which is used in a facsimile machine for example.

2. Description of the Prior Art

As is well-known, line-type thermal printing heads are widely used in facsimile machines for printing out transmitted information on thermosensitive paper. For the convenience of explanation, a typical prior art line-type thermal printing head is shown in FIG. 10 of the accompanying drawings.

As shown in FIG. 10, the prior art line-type thermal printing head comprises a metallic support plate 1 working also as a heat sink, and an insulating head substrate 2 mounted on the support plate. The upper surface of the head substrate 2 carries a heating resistor line 3 extending longitudinally of the substrate, and a common electrode 4 extending in parallel to the resistor line 3. The upper surface of the head substrate further carries an array of drive IC's 5.

The respective drive IC's 5 are electrically connected to the resistor line 3 through individual electrodes 6, whereas the common electrode 4 is electrically connected to the resistor line through comb-like teeth 7 in staggered relation to the individual electrodes 6. The common electrode 4 has a pair of power supply terminals 8 at both ends of the substrate for electrical connection to an external power source (not shown).

In operation, power is supplied at the connection terminals 8 to pass current through the common electrode 4, the respective comb-like teeth 7, the resistor line 3, and the individual electrodes 6. Thus, the resistor line 3 provides separate current paths divided by the individual electrodes 6 and the comb-like teeth 7, thereby forming a line of heating dots. The drive IC's 5 selectively actuate the heating dots to perform intended printing.

The common electrode 4, though made of a good conductive material, still exhibits its inherent resistivity. Therefore, the voltage applied across the respective heating dots of the resistor line 3 reduces toward the center of the resistor line due to an unavoidable voltage drop along the common electrode 4. Thus, the heating capability (namely the printing quality) becomes uneven along the length of the heating line 3. This problem is particularly serious if the overall length L' of the thermal head is large.

A solution to the above problem is to reduce the voltage drop by applying a wider metallic film or conductive layer over the common electrode, as disclosed in Japanese Patent Application Laid-open No. 57-24273, Japanese Utility Model Application Laid-open No. 61-183652 or Japanese Patent Application Laid-open No. 64-18649 for example. However, this solution may give rise to a new problem that the overlying film or layer, which is located above the common electrode, may come into interfering contact with the platen which is used for pressing the thermosensitive paper against the resistor line. Further, since the overlying film or layer is wider than the common electrode, the overall width W' (see FIG. 10) of the thermal head must be correspondingly increased.

SUMMARY OF THE INVENTION

It is, therefore, an object of the present invention to provide a line-type thermal printing head which can be reduced in overall width without inviting the problem of unacceptable voltage drop or printing quality deterioration.

Another object of the present invention is to provide a line-type thermal printing head which can be reduced not only in overall width but also in overall length without inviting the problem of unacceptable voltage drop or printing quality deterioration.

According to the present invention, there is provided a line-type thermal printing head comprising: an elongate support plate; an elongate head substrate mounted on the support plate, the head substrate having a support surface formed with a heating resistor line extending longitudinally of the head substrate, the support surface being further formed with a common electrode extending substantially in parallel to the resistor line adjacent to a longitudinal edge of the head substrate; and a strip-like auxiliary substrate mounted on the support plate to extend longitudinally of the head substrate substantially in parallel to the common electrode, the auxiliary substrate having a side surface which is substantially perpendicular to the support surface of the head substrate, the side surface being formed with a longitudinal conductor strip connected electrically to the common electrode through a longitudinal conductive member.

With the arrangement described above, since the common electrode is electrically connected to the longitudinal conductor strip of the auxiliary substrate through the longitudinal conductive member, the longitudinal conductor strip provides an additional current path for power supply. Thus, the effective power supply path is widened to reduce voltage drop without increasing the width of the common electrode itself.

On the other hand, since the longitudinal conductor strip is formed on the side surface of the auxiliary substrate which is substantially perpendicular to the support surface of the head substrate, only the thickness of the auxiliary substrate is additional to the overall width of the thermal printing head. Thus, it is possible to reduce the overall width of the thermal head by reducing the thickness of the auxiliary substrate.

According to a preferred embodiment of the present invention, the support plate has both ends each provided with an end substrate extending transversely of the head substrate, the end substrate having a side surface substantially perpendicular to the support surface of the head substrate, the side surface of the end substrate being formed with an end conductor strip extending longitudinally of the end substrate for electrical connection to the longitudinal conductor strip of the auxiliary substrate. Such an embodiment opens up the following two alternative arrangements.

In a first arrangement, the end conductor strip alone is used as a power supply terminal. Thus, there is no need to provide any power supply terminal on the head substrate, thereby making it possible to reduce the length of the head substrate.

In a second arrangement, the common electrode may be made to have a pair of power supply terminals extending transversely of the head substrate at both ends thereof, each power supply terminal being electrically connected to the end conductor strip of the end substrate through an end conductive member. However, the width of the power supply terminal need not be large due to the presence of the end conductor strip.

Obviously, in either alternative arrangement, the overall length of the thermal printing head can be rendered smaller than if wider power supply terminals are directly formed on the head substrate.

Other objects, features and advantages of the present invention will become apparent from the following detailed description of the preferred embodiments given with reference to the accompanying drawings.

DETAILED DESCRIPTION OF THE PREFERRED EMBODIMENT

Figure 1:
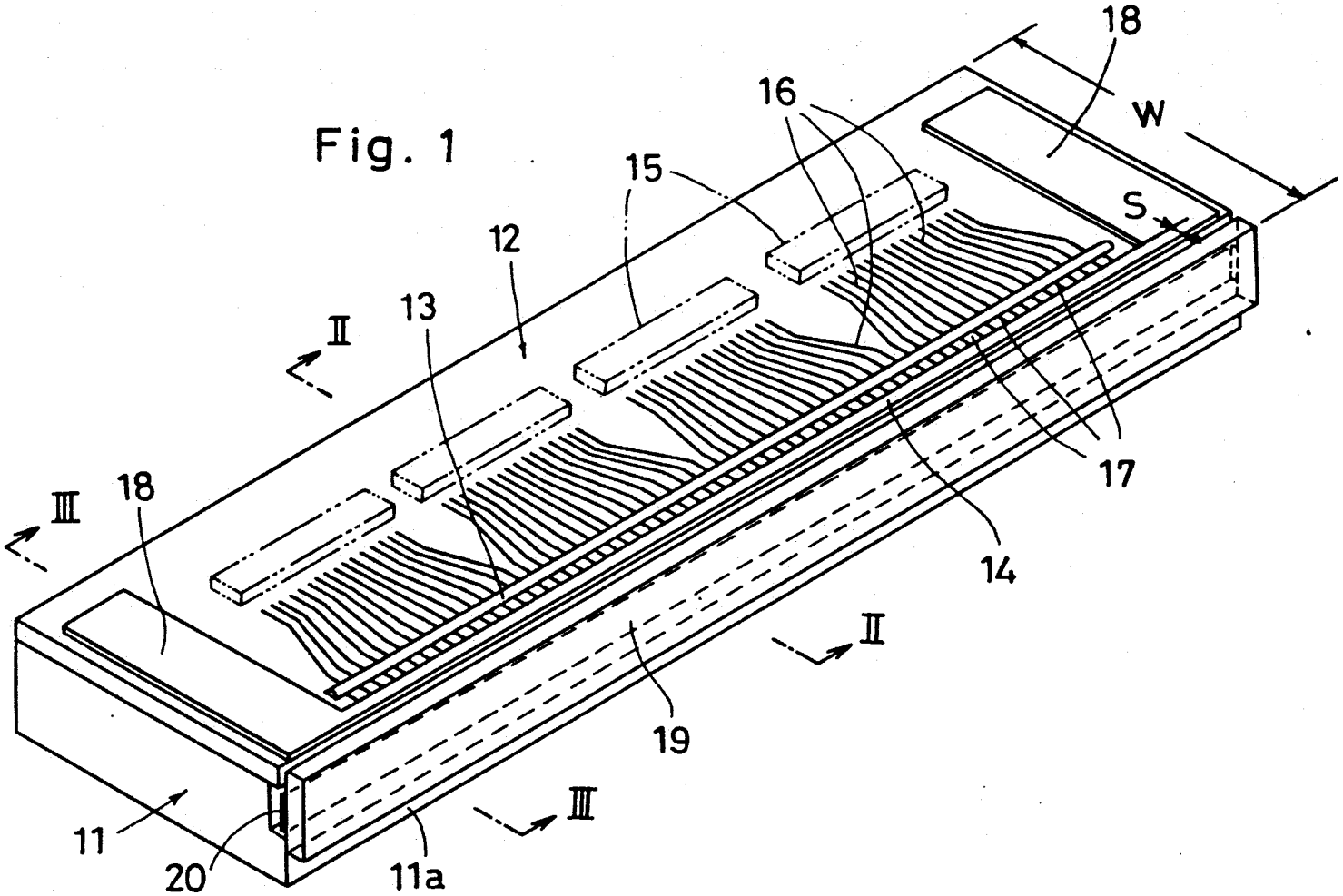
FIG. 1 is a perspective view showing a line-type thermal printing head embodying the present invention.
Figure 2:
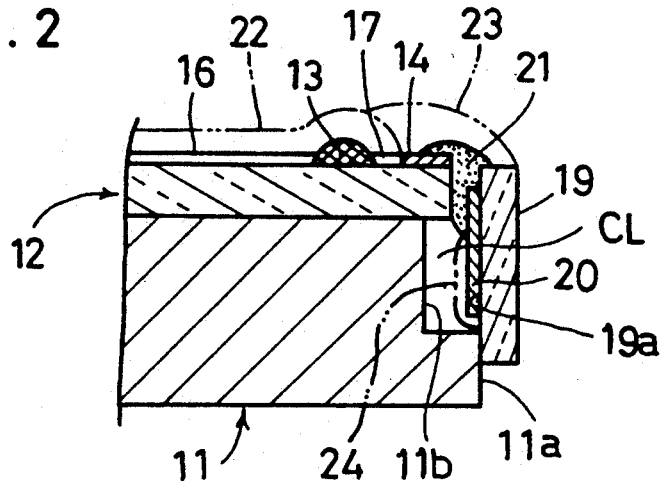
FIG. 2 is a sectional view taken along lines II—II in FIG. 1.
Figure 3:
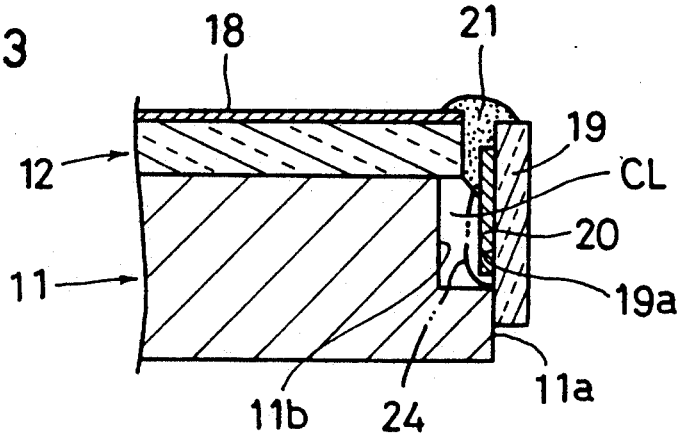
FIG. 3 is a sectional view taken along lines III—III in FIG. 1.

Referring first to FIGS. 1-3 of the accompanying drawings, a line-type thermal printing head according to the present invention mainly includes a metallic support plate 11 and a head substrate 12 attached onto the support plate. The support plate 11, which may be made of aluminum for example, works also as a heat sink. The head substrate 12 is made of an insulating material such as ceramic.

The head substrate 12 has an upper support surface formed with a heating resistor line 13 extending longitudinally of the substrate adjacent to one longitudinal edge thereof, and a common electrode 14 also extending longitudinally of the substrate further closer to that one longitudinal edge. The common electrode 14 is electrically connected to the resistor line 13 through a multiplicity of comb-like teeth 17. Further, the common electrode 14 has a pair of enlarged or wider power supply terminals 18 located at or near both ends of the substrate.

The upper surface of the head substrate 12 further carries a longitudinal array of drive IC's 15 which are electrically connected to the resistor line 13 through a multiplicity of individual electrodes 16 in staggered relation to the comb-like teeth 17 of the common electrode 14. Thus, the respective portions of the resistor line 13 between the comb-like teeth and the individual electrodes 16 provide heating dots in a line arrangement.

According to the illustrated embodiment of FIGS. 1-3, a longitudinal edge of the support plate 11 is utilized for mounting a strip-like auxiliary substrate 19 which is made of an insulating material such as glass-fiber-reinforced resin or paper-containing phenol resin. Specifically, the longitudinal edge of the support plate 11 includes a lower mounting edge surface **11*a* for attachment to the auxiliary substrate 19, and an upper longitudinal step 11*b* for providing a longitudinal clearance CL between the support plate 11 and the auxiliary substrate 19. The auxiliary substrate 19 may be attached to the mounting edge surface 11*a*** by adhesive or by bolts (not shown).

The strip-like auxiliary substrate 19, which extends longitudinally of the head substrate 12, has a side surface **19*a* loacted to face the head substrate and extending perpendicularly to the head substrate. The side surface 19*a* is formed with a longitudinal conductor strip 20 extending longitudinally of the auxiliary substrate 19. The conductor strip 20 has a thickness of 35-70 micrometers and may be made of metallic foil (e.g. copper foil) or electrically conductive paste. The conductor strip 20 is connected, in its entire length, to the common electrode 14 of the head substrate 12 by a longitudinal conductive member 21** which is made of electrically conductive adhesive or paste.

Preferably, the resistor line 13 may be covered by a glass coating 22, whereas the conductive member 21 together with the common electrode 14 may be covered by an insulation resinous coating 23, as shown in FIG. 2. Further, the conductor strip 20 may also be covered by an insulation resin coating 24.

With the arrangement described above, the common electrode 14 of the head substrate 12 may be made to have a relatively small width S (see FIG. 1). However, the voltage drop along the length of the common electrode 14 can be greatly reduced because it is electrically connected to the conductor strip 20 of the auxiliary substrate 19 via the conductive member 21.

On the other hand, the auxiliary substrate 19 is arranged perpendicularly to the head substrate 12 by utilizing the lower mounting edge surface **11*a* of the support plate 11. Thus, only the thickness of the auxiliary substrate 19, which can be easily rendered small, is additional to the overall width W (see FIG. 1) of the thermal printing head. Obviously, for the purpose of reducing the longitudinal voltage drop, this solution is much better than increasing the width of the common electrode 14 itself or laminating a wider metallic film (or layer) over the common electrode 14**.

In the embodiment of FIGS. 1-3, the upper longitudinal step **11*b* of the support plate 11 is necessary for providing the longitudinal clearance CL, thereby enabling the provision of the conductor strip 20 on the side surface 19*a* (inner side surface) of the auxiliary substrate 19 located closer to the head substrate 12. However, the conductor strip 20 may be formed on the other side surface (outer side surface) of the auxiliary substrate 19 positioned farther from the head substrate 12. In such an alternative arrangement, the upper step 11*b* together with the longitudinal clearance CL may be dispensed with. Further, the conductive member 21** may be made of solder, metallic foil or any other conductive material.

Figure 4:
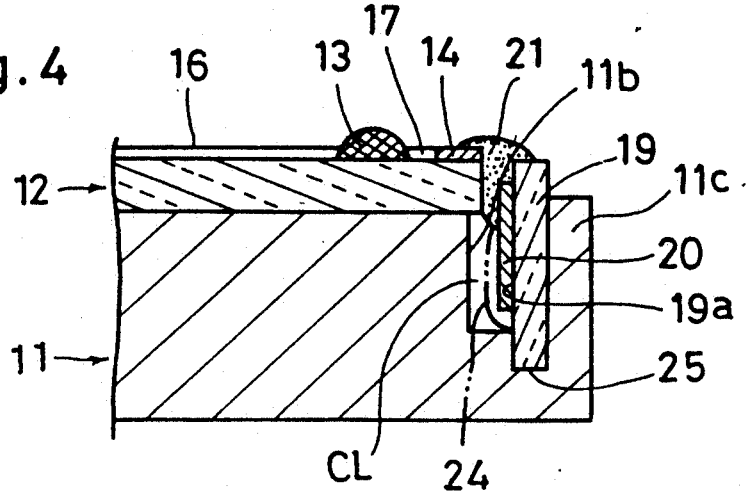
FIG. 4 is a sectional view similar to FIG. 2 but showing a modified thermal printing head according to the present invention.

FIG. 4 shows a modification of the foregoing embodiment wherein the support plate 11 is made to have a longitudinal groove 25 for fitting the auxiliary substrate 19. Further, the support plate 11 also has a longitudinal backup wall 11c for backing up the auxiliary substrate 19 from behind. Obviously, such a modified arrangement provides an improved mounting stability for the auxiliary substrate 19.

Figure 5:
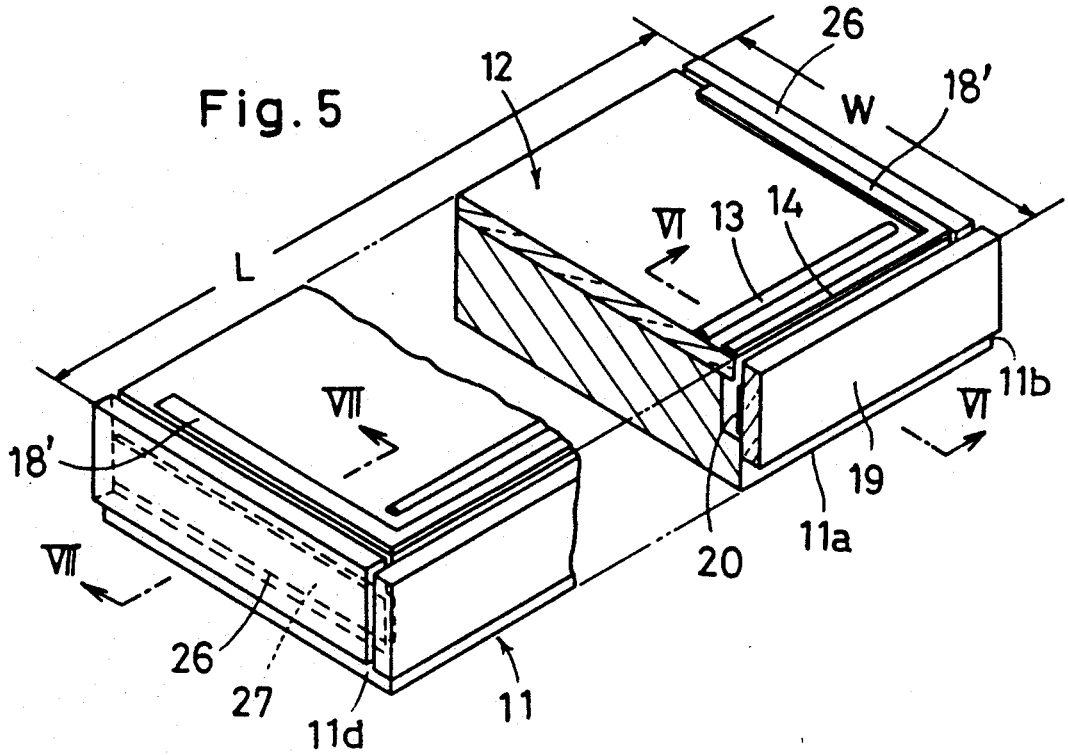
FIG. 5 is a perspective view showing another modified thermal printing head according to the present invention.
Figure 6:
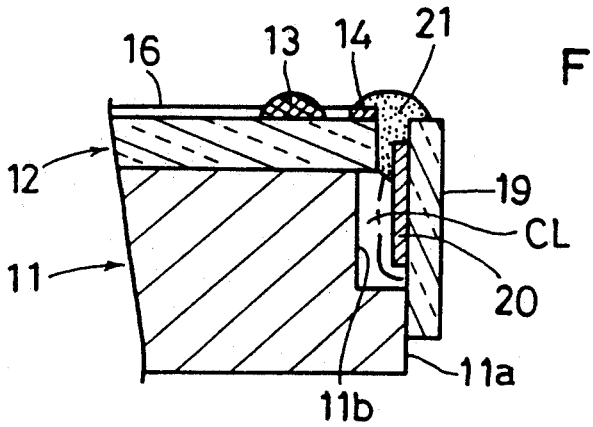
FIG. 6 is a sectional view taken along lines VI—VI in FIG. 5.
Figure 7:
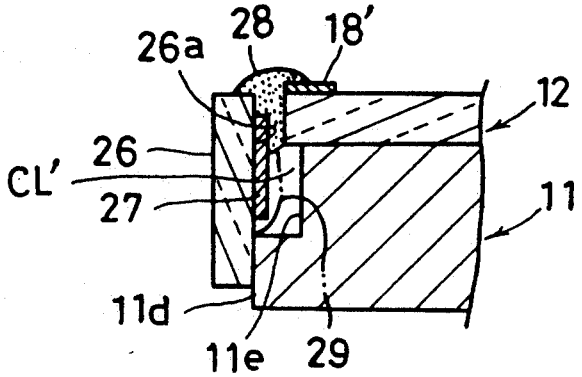
FIG. 7 is a sectional view taken along lines VII—VII in FIG. 5.

FIGS. 5–7 illustrate a line-type thermal printing head according to another modification of the present invention. The modified thermal head comprises a support member 11, a head substrate 12, a heating resistor line 13, a common electrode 14, an auxiliary substrate 19, a longitudinal conductor strip 20, and a longitudinal conductive member 21 in a manner similar to the embodiment of FIGS. 1–3. However, the common electrode 14 is made to have a pair of power supply terminals 18' which are narrower than those shown in FIGS. 1–3.

On the other hand, each end edge of the support plate 11 is utilized for mounting a strip-like end substrate 26 which is made of an insulating material such as glass-fiber-reinforced resin or paper-containing phenol resin. Specifically, the end edge of the support plate 11 includes a lower mounting end surface **11*d* for attachment to the end substrate 26, and an upper end step 11*e* for providing a transverse clearance CL' between the support plate 11 and the end substrate 26. The end substrate 26 may be attached to the mounting end surface 11*d*** by adhesive or by bolts (not shown).

The strip-like end substrate 26, which extends transversely of the head substrate 12, has a side surface **26*a* directed toward and extending perpendicularly to the head substrate. The side surface 26*a* is formed with an end conductor strip 27 extending longitudinally of the end substrate 26 for electrical connection to the longitudinal conductor strip 20 of the auxiliary substrate 19. The conductor strip 27 has a thickness of 35–70 micrometers and may be made of metallic foil (e.g. copper foil) or electrically conductive paste. The conductor strip 27 is connected, in its entire length, to the corresponding power supply terminal 18' of the head substrate 12 by an end conductive member 28 which is made of electrically conductive adhesive, electrically conductive paste, or solder. Preferably, the end conductor strip 27 may be covered by an insulation resin coating 29**.

Obviously, because of the provision of the auxiliary substrate 19 and its associated components, the embodiment of FIGS. 5–7 enjoys the same advantages as the embodiment of FIGS. 1–3. Further, since the width of each power supply terminal 18' is reduced by utilizing the end conductor strip 27, it is possible to reduce the overall length L of the thermal printing head without increasing the voltage drop a the power supply terminal 18'.

Figure 8:
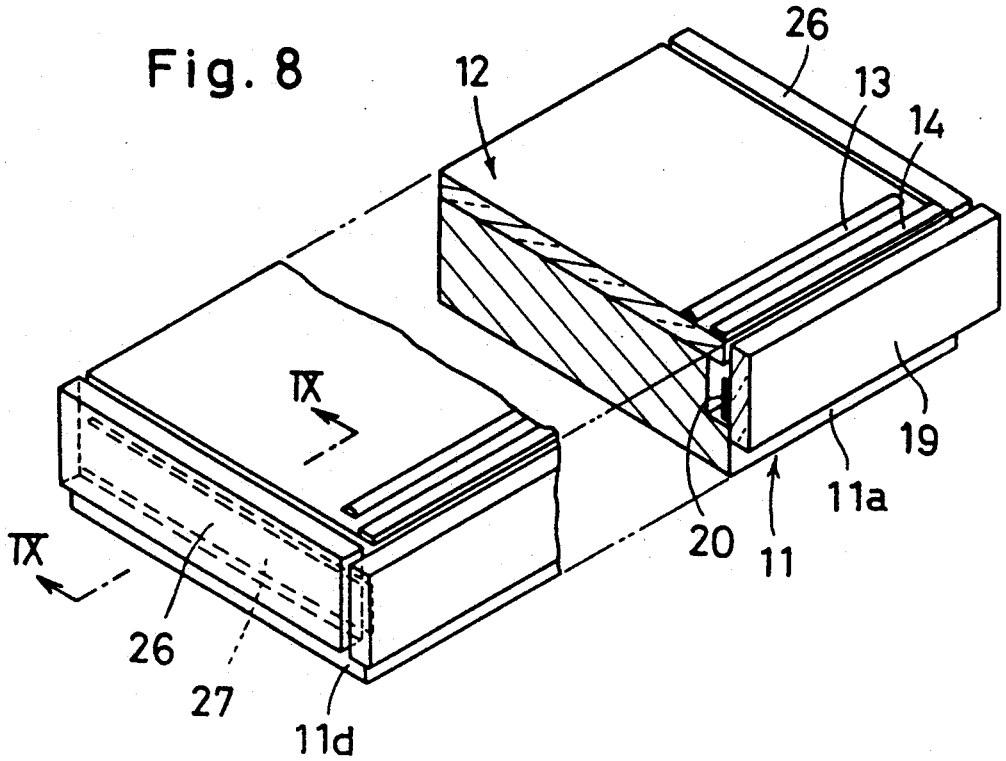
FIG. 8 is a perspective view showing a further modified thermal printing head according to the present invention.
Figure 9:
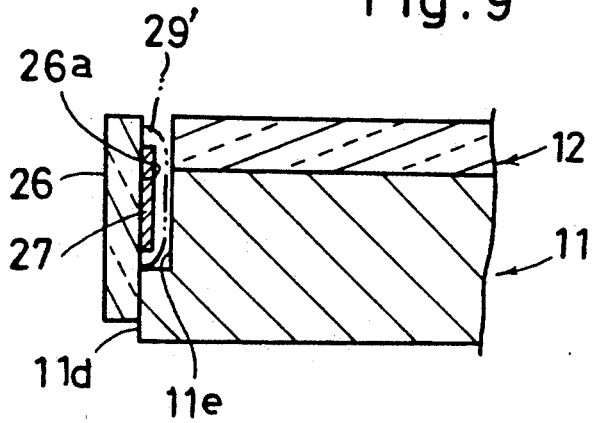
FIG. 9 is a sectional view taken along lines IX—IX in FIG. 8.
Figure 10:
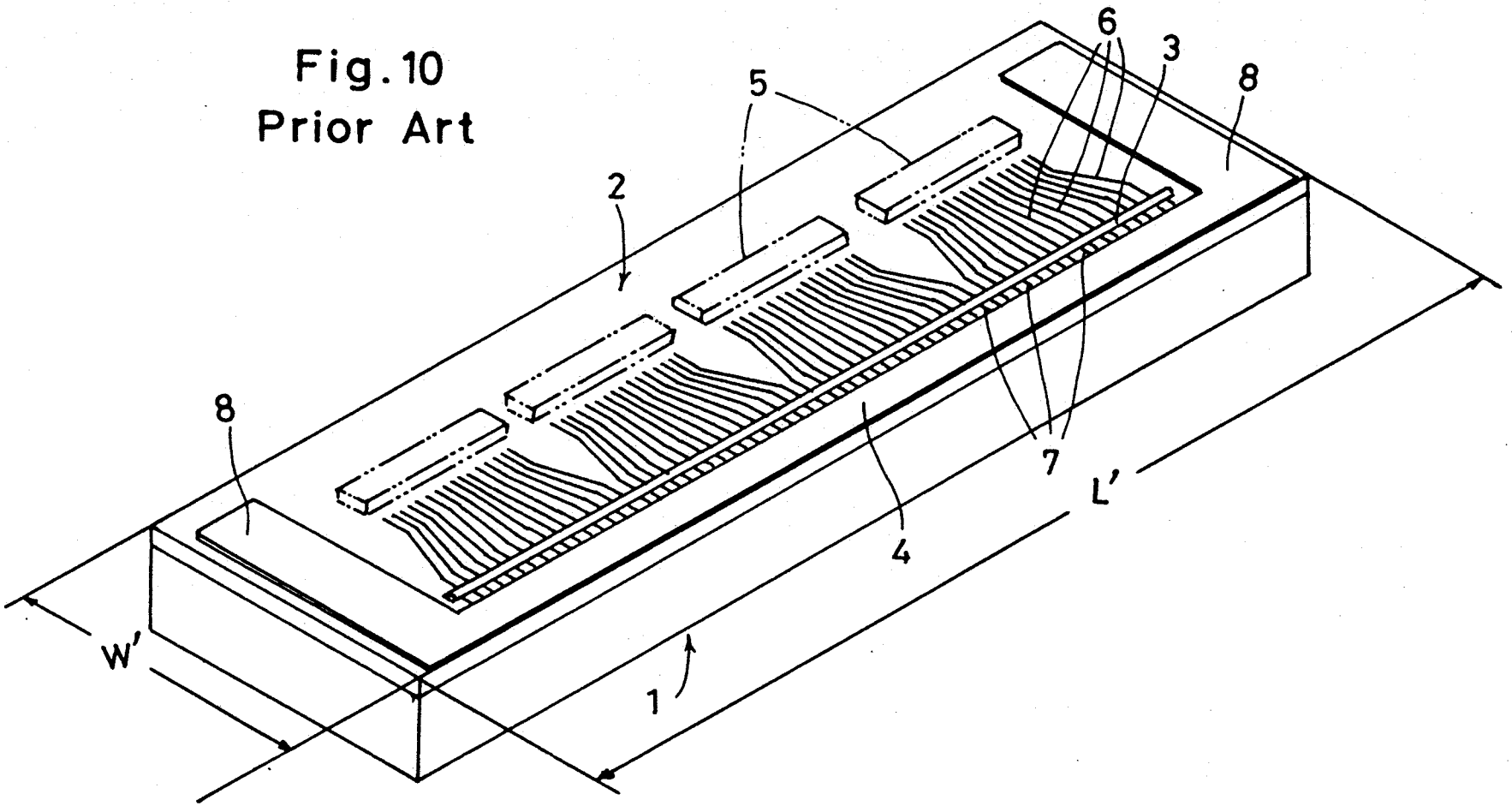
Fig. 10 Prior Art
FIG. 10 is a perspective view showing a prior art line-type thermal printing head.

FIGS. 8 and 9 shows a further modified thermal printing head which is similar to the printing head of FIGS. 5–7 but differs therefrom only in that the common electrode 14 itself has no power supply terminal. Instead, each end conductor strip 27, which is covered by an insulating resin coating 29', is made to work as a power supply terminal.

The present invention being thus described, it is obvious that the same may be varied in many ways. Such variations are not to be regarded as a departure from the spirit and scope of the the invention, and all such modifications as would be obvious to those skilled in the art are intended to be included within the scope of the following claims.

I claim:

1. A line-type thermal printing head comprising:

an elongate support plate;

an elongate head substrate mounted on the support plate, the head substrate having a support surface formed with a heating resistor line extending longitudinally of the head substrate, the support surface being further formed with a common electrode extending substantially in parallel to the resistor line adjacent to a longitudinal edge of the head substrate; and a strip-like auxiliary substrate mounted on the support plate to extend longitudinally of the head substrate substantially in parallel to the common electrode, the auxiliary substrate being entirely distinct from the head substrate, the auxiliary substrate having a side surface which is substantially perpendicular to the support surface of the head substrate, said side surface being formed with a longitudinal conductor strip connected electrically to the common electrode through means for conducting electricity.

2. The thermal printing head according to claim 1, wherein said side surface of the auxiliary substrate faces the head substrate with a slight spacing, at least a portion of the conducting means being located in said spacing to electrically connect between the common electrode and the longitudinal conductor strip.

3. The thermal printing head according to claim 2, wherein the support plate has a longitudinal step to provide a clearance between the support plate and said side surface of the auxiliary substrate.

4. The thermal printing head according to claim 1, wherein the support plate has a longitudinal mounting edge surface for attachment to the auxiliary substrate.

5. The thermal printing head according to claim 1, wherein the support plate has a longitudinal groove in which the auxiliary substrate is fitted

6. The thermal printing head according to claim 1, wherein the support plate has a backup wall for backing up the auxiliary substrate from behind.

7. The thermal printing head according to claim 1, wherein the support plate has two ends extending transversely to the heating resistor line, each of said ends being provided with an end substrate extending transversely of the head substrate, the end substrate having a side surface substantially perpendicular to the support surface of the head substrate, said side surface of the end substrate being formed with an end conductor strip extending longitudinally of the end substrate for electrical connection to the longitudinal conductor strip of the auxiliary substrate.

8. The thermal printing head according to claim 7, wherein the common electrode has a pair of power supply terminals extending transversely of the head substrate at said ends thereof, each of said power supply terminals being electrically connected to the end conductor strip of the end substrate through the means for conducting electricity.

9. The thermal printing head according to claim 8, wherein said side surface of each of the end substrates faces the head substrate with a slight spacing, at least a portion of the end conducting means being located in said spacing to electrically connect between said each power supply terminal and the end conductor strip.

10. The thermal printing head according to claim 7, wherein the support plate has an end extending parallel to the heating resistor line, said end having an end step to provide a clearance between the support plate and said side surface of the end substrate.

11. The thermal printing head according to claim 7, wherein said ends of the support plate has a mounting end surface for attachment to the end substrate.

* * * * *